US007874458B2

(12) United States Patent
Sogaro

(10) Patent No.: US 7,874,458 B2
(45) Date of Patent: Jan. 25, 2011

(54) MULTICHAMBER DISPENSING SYSTEM

(75) Inventor: Alberto C. Sogaro, Kronberg (DE)

(73) Assignee: Dentaco Dentalindustrie und - Marketing GmbH, Bad Homburg (DE)

( * ) Notice: Subject to any disclaimer, the term of this patent is extended or adjusted under 35 U.S.C. 154(b) by 371 days.

(21) Appl. No.: 11/914,576

(22) PCT Filed: May 4, 2006

(86) PCT No.: PCT/EP2006/004184

§ 371 (c)(1),
(2), (4) Date: Nov. 16, 2007

(87) PCT Pub. No.: WO2006/122659

PCT Pub. Date: Nov. 23, 2006

(65) Prior Publication Data

US 2008/0203111 A1 Aug. 28, 2008

(30) Foreign Application Priority Data

May 18, 2005 (EP) ..... 05010797

(51) Int. Cl.
*B67D 7/70* (2010.01)
*B67D 7/60* (2010.01)

(52) U.S. Cl. ..... 222/137; 222/145.5; 222/386; 222/506

(58) Field of Classification Search ..... 222/135, 222/137, 145.5, 146.5, 386, 505, 506, 507, 222/509, 325, 326, 327, 519, 520, 522, 523, 222/525

See application file for complete search history.

(56) References Cited

U.S. PATENT DOCUMENTS 3,570,719 A * 3/1971 Schiff ..... 222/137
4,240,566 A 12/1980 Bergman
5,301,842 A * 4/1994 Ritter ..... 222/137

(Continued)

FOREIGN PATENT DOCUMENTS

CA 1 211 385 9/1986

(Continued)

OTHER PUBLICATIONS

International Search Report corresponding to PCT/EP2006/004184 under date of mailing of Jul. 14, 2006.

*Primary Examiner*—Kevin P Shaver
*Assistant Examiner*—Stephanie E Williams
(74) *Attorney, Agent, or Firm*—Quarles & Brady LLP

(57) ABSTRACT

Disclosed is a multichamber dispensing system for dispensing a mixture containing several substances. Said dispensing system comprises a receiving unit (10) with several chambers (12, 14) which are aligned parallel to each other and each of which is provided with a first end for inserting a plunger (21, 23) as well as a second end encompassing an outlet (11, 13), and with a neck region (15) that is located downstream from the outlet(11, 13) of the chambers (12, 14). The dispensing system further comprises a dispensing unit (30) that is provided with a discharge duct (33) and an adapter section for establishing a fluid-tight connection to the neck region (15) for the receiving unit (10). The inventive multichamber dispensing system also comprises a position ring (40) for axially positioning the dispensing unit (30). Said positioning ring (40) is rotatably mounted on the receiving unit and embraces the receiving unit (20).

25 Claims, 7 Drawing Sheets

Figure 1:
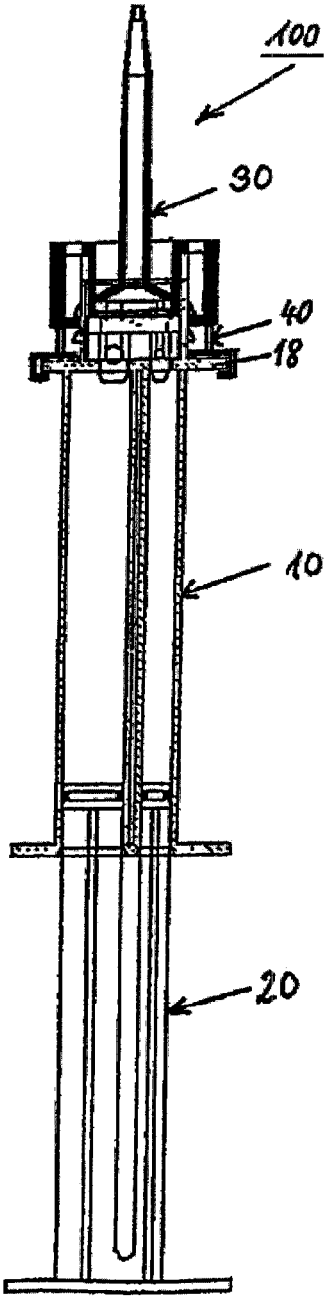

U.S. PATENT DOCUMENTS 5,944,226 A * 8/1999 Schiltz et al. ..... 222/137
6,135,631 A * 10/2000 Keller ..... 366/339
6,161,730 A * 12/2000 Heusser et al. ..... 222/137
6,352,177 B1 * 3/2002 Bublewitz et al. ..... 222/82
6,769,574 B1 8/2004 Keller
6,820,766 B2 * 11/2004 Keller et al. ..... 222/137

FOREIGN PATENT DOCUMENTS

EP 1 203 593 5/2002

* cited by examiner

MULTICHAMBER DISPENSING SYSTEM

The invention concerns a multichamber dispensing device for dispensing of a mixture consisting of several substances according to the preamble of patent claim 1.

Such a multichamber dispensing system is known from EP 1 203 593 A1 and is designed as a throw-away article for onetime use.

The basic problem of the invention is to create a multichamber dispensing device suitable for repeated use, which is easy to handle and economical to produce.

This problem is solved by the multichamber dispensing device with the features of patent claim 1.

The subject of the invention is therefore a multichamber dispensing device for dispensing of a mixture consisting of several substances, comprising a receiving unit with several chambers which are aligned parallel to each other and each of which is provided with a first end for inserting a plunger as well as a second end encompassing an outlet, and with a neck region that is located downstream from the outlet openings of the chambers. Furthermore the dispensing system comprises a dispensing unit that is provided with a discharge duct and an adapter section for establishing a fluid-tight connection to the neck region of the receiving unit. According to the invention, a positioning ring is provided for axially positioning the dispensing unit, being rotatably mounted on the receiving unit and engaging with the dispensing unit.

Thus, a multichamber dispensing device is provided with a positioning ring, by means of which an axial positioning of the dispensing unit can be done, so that the dispensing unit can travel in the axial direction for separation from the receiving unit and be replaced by a new dispensing unit. Moreover, the positioning ring can act on the dispensing unit, for example, in such a way that the dispensing unit can travel between a closed position, in which a fluid flow is blocked between the chambers of the receiving unit, generally fashioned as essentially a multichamber syringe body, and the discharge duct, and a dispensing position, in which a fluid flow is made possible between the chambers of the receiving unit and the discharge duct.

The dispensing unit can be separated from the receiving unit immediately after making use of the multichamber dispensing device and be replaced by a new dispensing unit, so that no more substances are present downstream from the outlet openings of the chambers of the receiving unit. With the removal of the dispensing unit, portions of the substances otherwise kept in the chambers that have emerged from the chambers of the dispensing unit and are sticking to it are also eliminated. The newly inserted dispensing unit can then once more block a fluid flow between the chambers of the receiving unit and the discharge duct of the dispensing unit by an appropriate choice of the turning position of the positioning ring, until the time when the positioning ring is turned through an angle of rotation and the dispensing unit can be positioned such that a fluid flow is opened up between the chambers of the receiving unit and the discharge duct of the dispensing unit. The substances contained in the individual chambers can mingle downstream from the outlet openings of the chambers and upstream from the discharge duct.

The chambers of the receiving unit can have different or identical volumes, so that a mix ratio between the substances kept separately in the chambers can be adjusted by appropriate design of the respective outlet openings.

In a preferred embodiment of the multichamber dispensing device of the invention, the positioning ring has at least one position of turn constituting a position of rest, in which a flow of substance between the chambers and the discharge duct is blocked by means of the dispensing unit, and a second position of turn constituting a dispensing position, in which the substances can be delivered from the chambers of the receiving unit by a plunger pressure in the discharge duct and be applied through the latter. A user of the invented multichamber dispensing device can thus operate the positioning ring in a defined manner, which facilitates the handling of the multichamber dispensing device.

In order for the user to be able to feel the respective positions of the positioning ring, the positioning ring preferably engages with a locking device in the position of rest and the dispensing position. This consists, for example, of a locking lug fashioned on the receiving segment, which can engage with recesses of the positioning ring. It is also possible to fashion a locking lug on the positioning ring.

In a special embodiment of the multichamber dispensing device of the invention, the positioning ring is mounted on a plate extending transversely to the longitudinal axis of the chambers, being formed in the region of the second end of the receiving unit. Thus, a bearing plate is available for the positioning ring, enabling an exact axial positioning of the positioning ring.

In order to assure a captive mounting of the positioning ring on the receiving unit, the positioning ring can have an annular groove, in which the outer marginal region of the front plate engages.

In order to facilitate the separating of the dispensing unit from the receiving unit, the positioning ring preferably comprises at least one ramp, so that the dispensing unit experiences an axial offset when the positioning ring is turned. The ramp is configured, for example, so that a turning of the positioning ring clockwise or also counterclockwise allows the dispensing unit to be removed from the receiving unit. Alternatively, the ramp can also be formed on the dispensing unit, in which case the positioning ring can slide along the ramp by a region configured for this when it is turned.

In particular, the end region of the ramp away from the chambers defines a third position of turning of the positioning ring, constituting an ejecting or removal position, in which the dispensing unit can be easily removed from the neck region of the receiving unit.

In a special embodiment of the multichamber dispensing device of the invention, the dispensing unit moves out from the neck region of the receiving unit by means of the ramp by turning the positioning ring. Thus, in this case, the dispensing unit is inserted into the neck region of the receiving unit before the corresponding operation of the positioning ring.

The ramp of the positioning ring can extend across an angle region of, say, between around 90 and 160 degrees in regard to the axis of the essentially cylindrical neck region of the receiving unit.

In order to assure a reliable functioning of the positioning ring, it is beneficial for the dispensing unit to be mounted in the neck region unable to rotate. The fixed mounting can be accomplished, for example, in that the neck region has an elliptical cross section and/or by arranging a turn preventer for the dispensing unit in the neck region. The turn preventer is formed, for example, from a projection engaging in a recess of the dispensing unit. Such a configuration also facilitates a definite connection of the dispensing unit to the neck region of the receiving unit.

In order to guarantee the proper functional interplay between the positioning ring and the dispensing unit, at least one positioning arm or a positioning bracket can be fashioned on the dispensing unit, thrusting against the positioning ring. Preferably, two positioning arms displaced by 180 degrees relative to each other are provided on the dispensing unit, each of which interacts with a correspondingly fashioned region of the positioning ring.

Preferably, a cross member is fashioned on the dispensing unit, from which the positioning arm or the positioning bracket stands off in the direction of the chambers of the receiving unit.

In one special embodiment of the multichamber dispensing device of the invention, the positioning ring is configured such that the positioning arm lies against a shoulder of the positioning ring in the first position of turn, constituting the position of rest. A turning of the positioning ring into the second position of turn, constituting the dispensing position, then frees up the dispensing unit so that it can be handily pressed in the direction of the chambers of the receiving unit, which in turn can free up a fluid flow between the chambers and the discharge duct of the dispensing unit. A further turning of the positioning ring in the same direction of turning then lets the positioning arm slide by its end face along the ramp of the positioning ring, which in turn brings about an axial displacement of the dispensing unit in the direction away from the chambers, so that the dispensing unit can either be ejected or also simply taken out from the receiving unit.

In order to secure the dispensing unit against an inadvertent loosening of the receiving unit, at least one stop for the positioning arm is arranged on the outer wall of the neck region, preferably interacting with a cross piece of the positioning arm. The stop can secure the dispensing unit in the position of rest and/or in the dispensing position of the positioning ring. For example, two stops are fashioned for each positioning arm, one behind the other in the axial direction of the multichamber dispensing device, each one being coordinated with one operating position of the dispensing unit. In order to facilitate placing the dispensing unit on the neck region or moving the dispensing unit from the blocking position to the release position, the stop or stops can have a bevel on the side away from the chambers of the receiving unit.

In order to prevent an unwanted mixing of the substances in the chambers of the receiving unit downstream from the outlet openings, the dispensing unit is preferably provided with a closing unit for the outlet openings of the chambers.

The closing unit can contain a closure plug coordinated with the respective outlet opening for each of the chambers. Therefore, the closing unit is a multiple-plug closure.

The closure plugs can be configured so that they free up in their open position, i.e., in the dispensing position of the positioning ring, a flow of substance from the chambers of the receiving unit to a mixing chamber, for example, one provided with a static mixer, arranged in the dispensing unit upstream from the discharge duct.

The closure plugs for this purpose can be configured so that they are each provided with a transverse channel, which is connected to a blind axial channel of the respective closure plug, which leads to the mixing chamber.

Furthermore, the closing unit can have a platelike body (46; 146), which is rotatably supported at the side of the dispensing unit facing the receiving unit. This enables an easy positioning of the closing unit with respect to the outlet openings of the chambers of the receiving unit in the circumferential direction.

Locking means can be fashioned on the dispensing unit and the platelike body of the closing unit, which cooperate in such a way that the dispensing unit and the closing unit can lock together in a given position of angular turning.

Moreover, a shoulder projecting in the transverse direction can be formed on the platelike body of the closing unit, which interacts with a longitudinal groove fashioned inside the neck region so that the closing unit can only be inserted into the neck region in one given position of angular turning, in which the closure plugs of the closing unit are each aligned with respective outlet openings of the chambers.

Further benefits and advantageous embodiments of the subject of the invention will be found in the specification, the drawing, and the patent claims.

Figure 2:
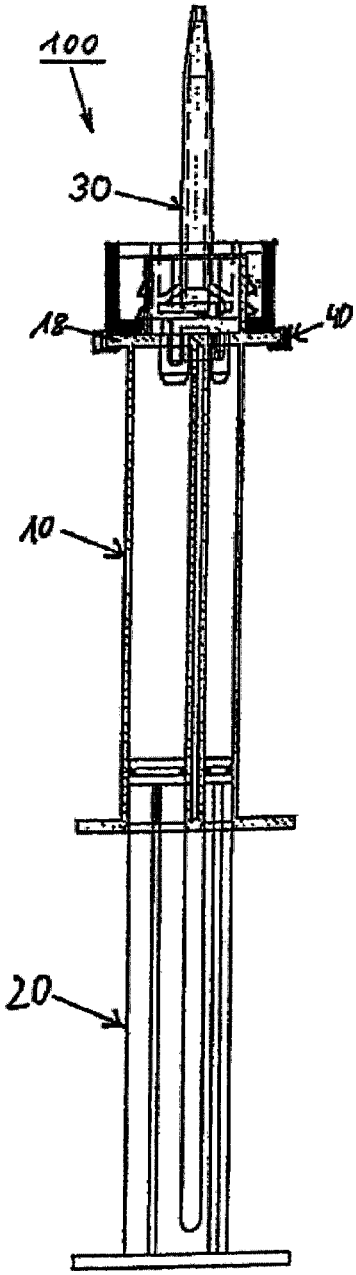
Figure 3:
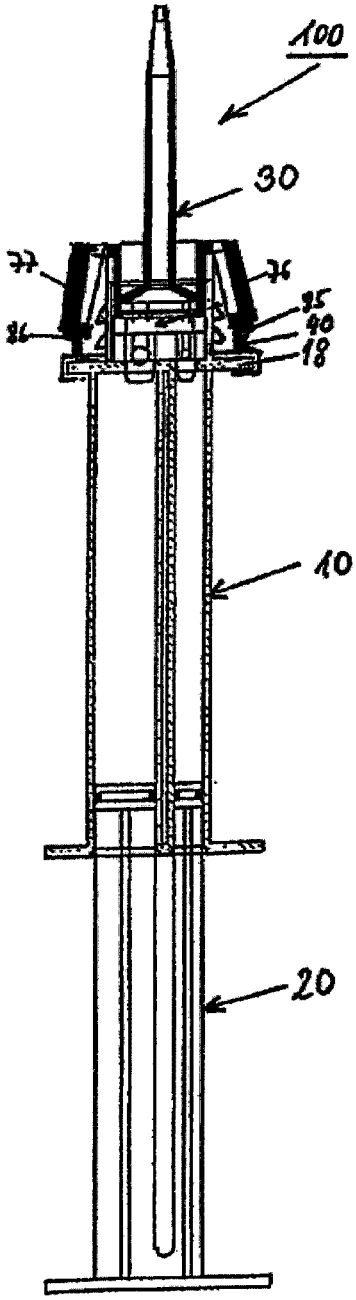
Figure 4:
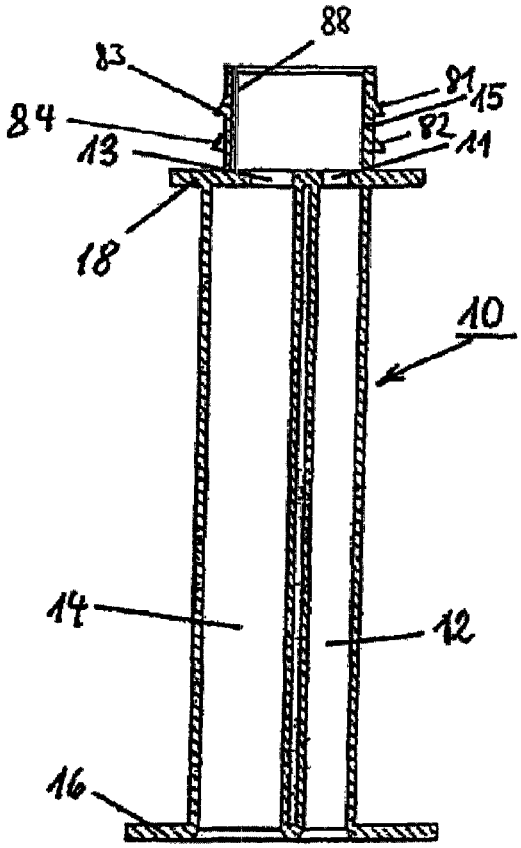
Figure 5:
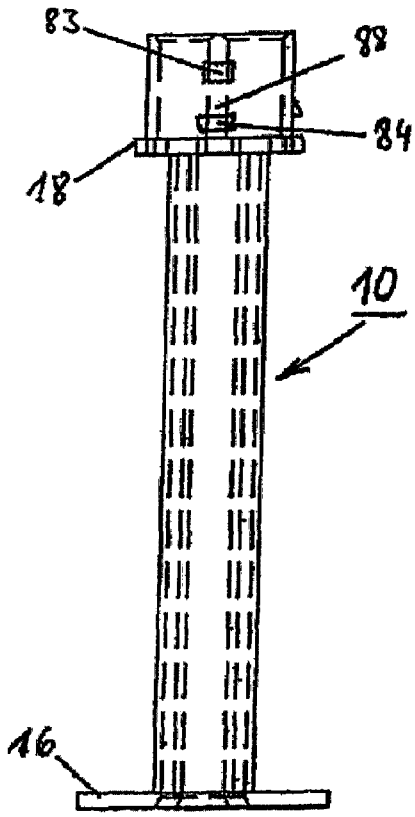
Figure 6:
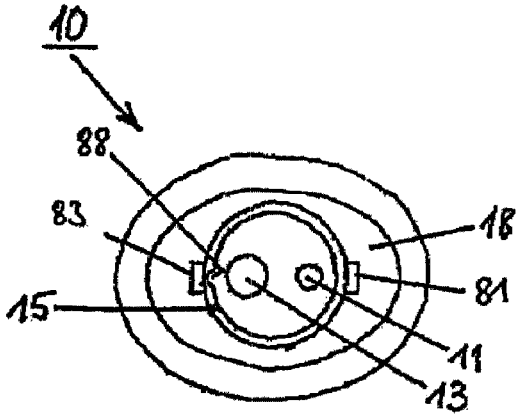
Figure 7:
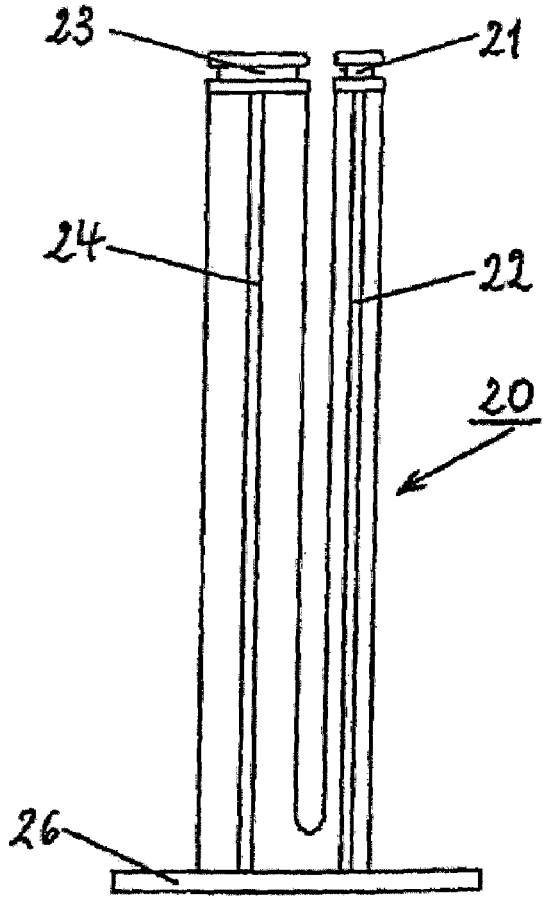
Figure 8:
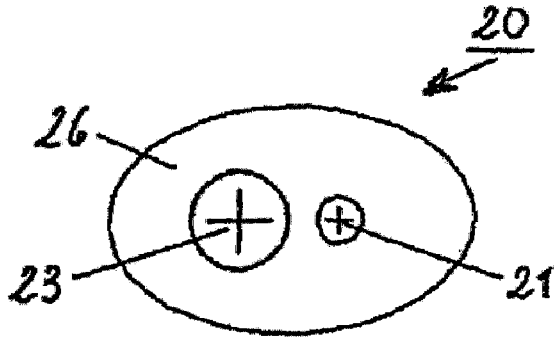
Figure 9:
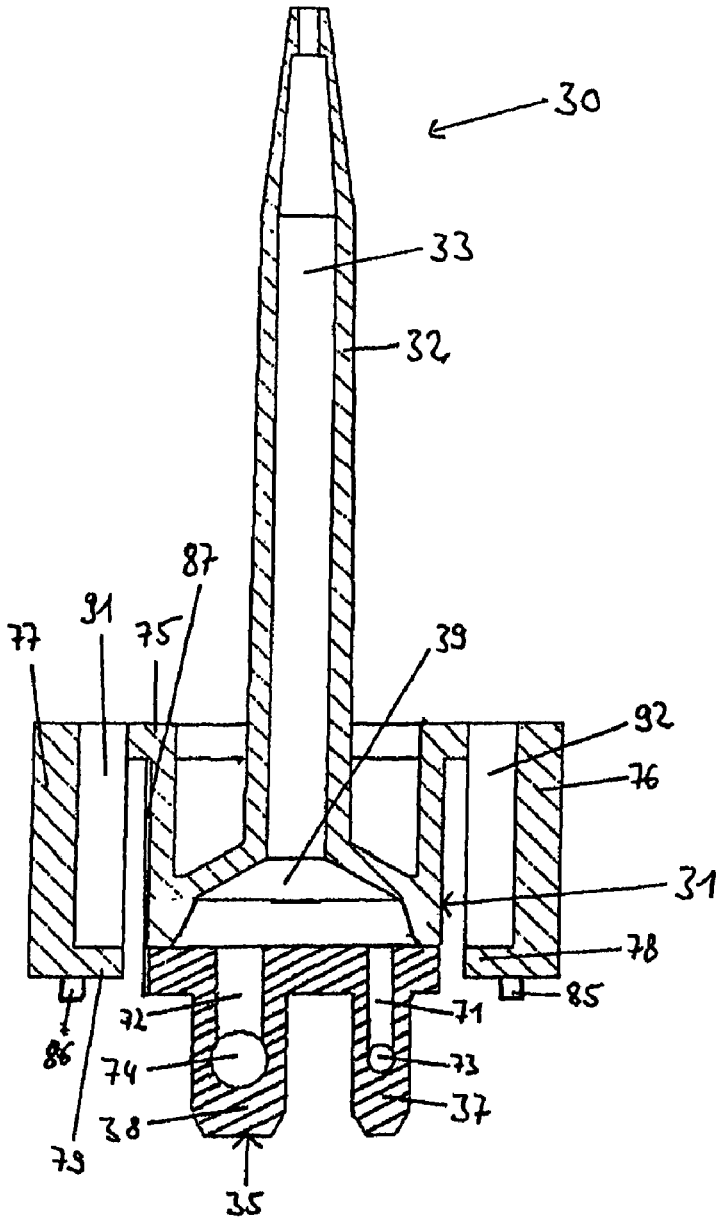
Figure 10:
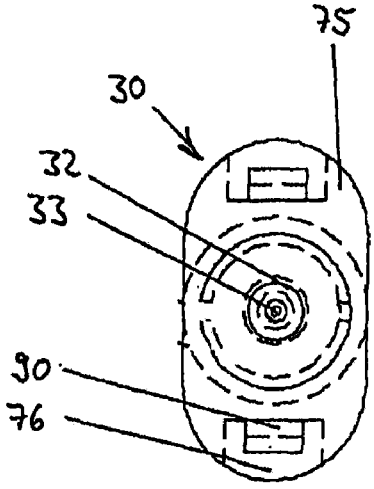
Figure 11:
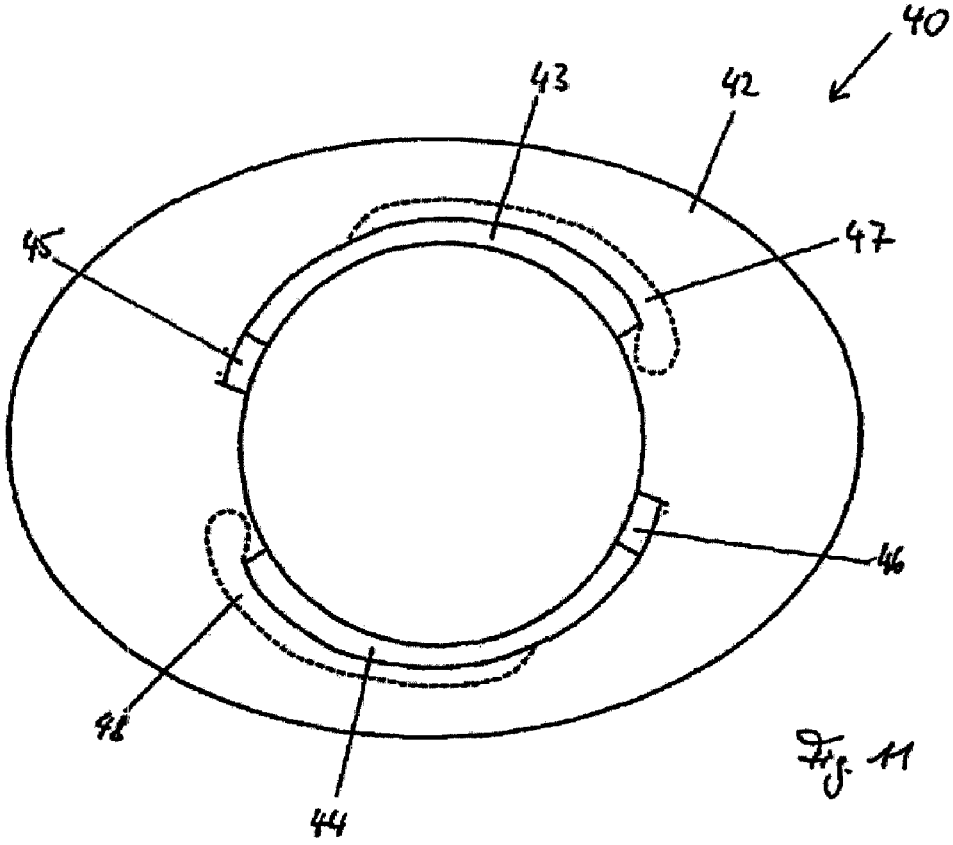
Figure 12:
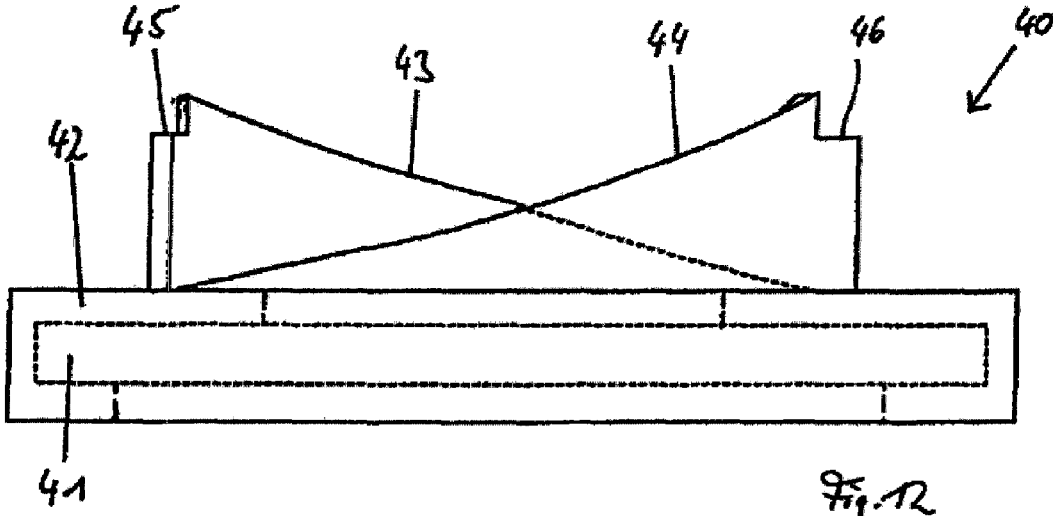
Figure 13:
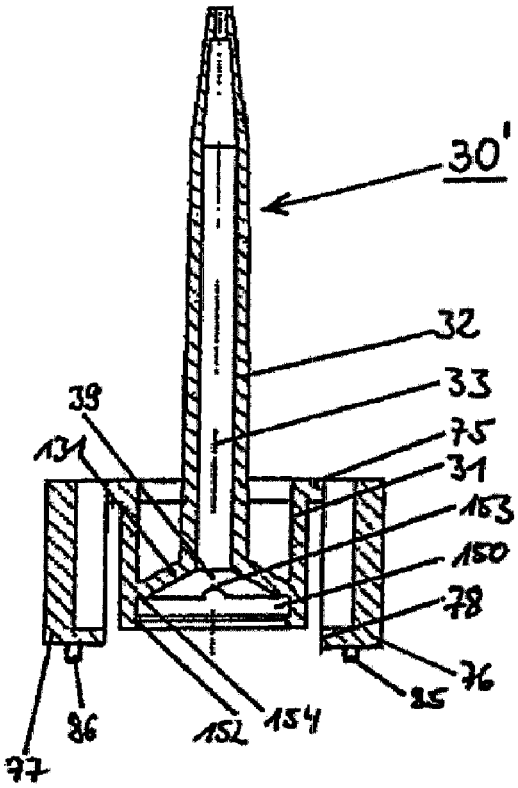
Figure 14:
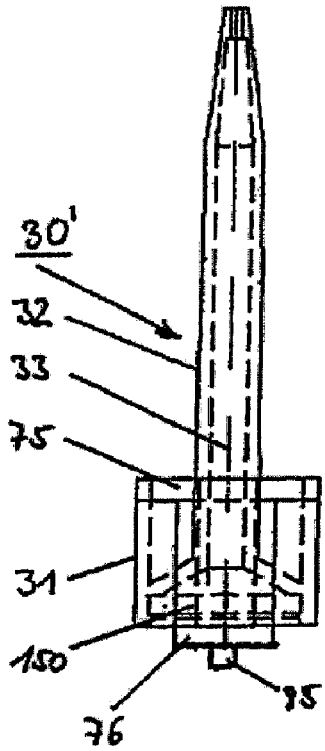
Figure 15:
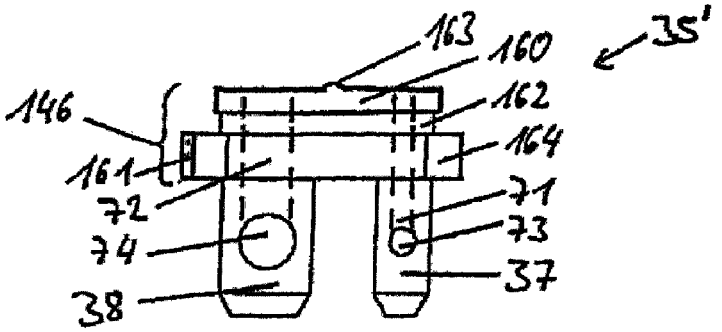
Figure 16:
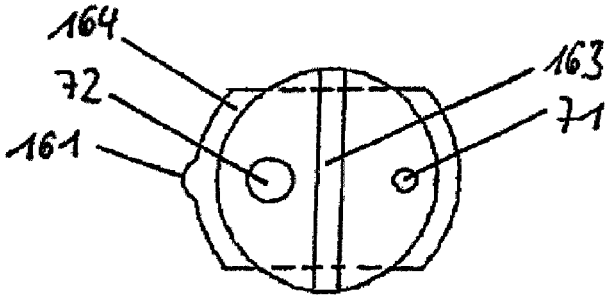

Two sample embodiments of the multichamber dispensing device per the invention are shown schematically simplified in the drawing and shall be explained more closely in the following specification. This shows:

FIG. 1, a partially cut-open side view of a sample embodiment of a multichamber dispensing device according to the invention in the closed condition;

FIG. 2, a view of the multichamber dispensing device corresponding to FIG. 1, but in the activated condition;

FIG. 3, a view of the multichamber dispensing device corresponding to FIG. 1, but with one dispensing unit removed;

FIG. 4, a longitudinal section through a receiving unit of the multichamber dispensing device;

FIG. 5, a side view of the receiving unit, turned by 90 degrees relative to FIG. 4;

FIG. 6, a plan view of the receiving unit represented in FIG. 4;

FIG. 7, a side view of a plunger unit of the multichamber ampoule;

FIG. 8, a plan view of the plunger unit shown in FIG. 7;

FIG. 9, a longitudinal section of a dispensing unit of the multichamber dispensing device;

FIG. 10, a plan view of the dispensing unit shown in FIG. 9;

FIG. 11, a plan view of a positioning ring of the multichamber dispensing unit;

FIG. 12, a side view of the positioning ring shown in FIG. 11;

FIG. 13, a longitudinal section through a dispensing unit of a second embodiment of a multichamber dispensing device per the invention;

FIG. 14, a side view of the dispensing unit of FIG. 13;

FIG. 15, a side view through a closing unit which can be connected to the dispensing unit shown in FIG. 13;

FIG. 16, a plan view of the closing unit in FIG. 15; and

Figure 17:
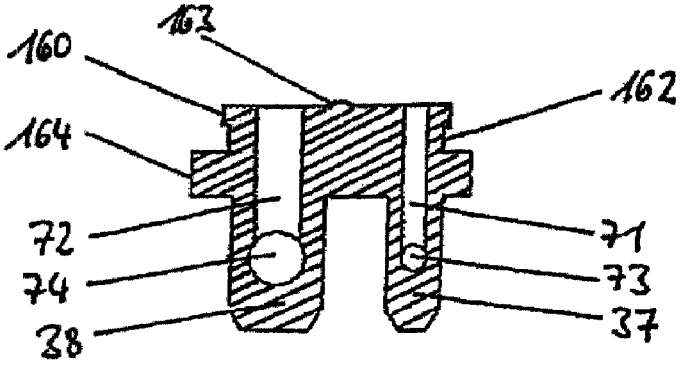

FIG. 17, a longitudinal section through the closing unit of FIG. 15.

FIGS. 1 through 12 show a two-chamber ampoule 100, which is basically composed of four structural units, namely, a receiving unit 10, a plunger unit 20, a dispensing unit 30, and a positioning ring 40.

In particular, one can see in FIGS. 4 to 6 that the container-like receiving unit 10 comprises two tubular chambers 12 and 14, arranged in parallel alongside each other, and extending in the longitudinal direction of the container 10. The chambers 12 and 14 are open in configuration for their entire cross section at their first end, shown at bottom in the drawing. A back plate 16 is formed on the outer sides of the first ends of the chambers 12 and 14, extending in the transverse or radial direction. The second ends of the chambers 12 and 14, facing away from the first ends, are joined to each other by a molded-on front plate 18. In the front plate 18, one outlet opening 11 for the chamber 12 and one outlet opening 13 for the chamber 14 are fashioned.

At the side away from the chambers 12 and 14, a neck region 15 is formed on the front plate 18, which frames the outlet openings 11 and 13 and is basically cylindrical in configuration. The axis of the neck region 15 is arranged parallel to the axes of the chambers 12 and 14. In the present sample embodiment, the chamber 14 has a much larger cross section than the chamber 12. Accordingly, the outlet opening 13 also has a much larger cross section than the outlet opening 11. Alternatively, the chambers 12 and 14 can also have the same cross sections or also be formed with any other desired cross section relationships. The same holds for the outlet openings 11 and 13.

As is especially evident from FIGS. 7 and 8, the plunger unit 20 comprises two plunger rods 22 and 24, whose rear ends are joined together by a push plate 26. At the front end of the plunger rod 22 there is fashioned a plunger 21 for the chamber 12 of smaller diameter. At the front end of the plunger rod 24, a plunger 23 is fashioned for the chamber 14 of larger diameter. The diameters of the plungers 21 and 23 correspond to the inner diameters of the chambers 12 and 14. The plungers 12 and 14 can be introduced into the rear open ends of the chambers 12 and 14 and be pushed in them at the same time and fluid-tight.

The dispensing unit 30, presented in particular in FIGS. 9 and 10, comprises an adapter segment 31 for coupling to the receiving unit 10, as well as a tubular segment 32, in which an axial discharge duct 33 is fashioned, leading to the free end face of the tubular segment 32. The adapter segment 31 has a cylindrical segment 34 with an outer diameter corresponding to the inner diameter of the neck region 15 of the receiving segment 10 and thus it can be inserted into the open end of the neck region 15 and be moved therein fluid-tight.

Furthermore, the dispensing unit 30 contains in the region of the adapter segment 31 a closing unit 35 for the outlet openings 11 and 13 of the chambers 12 and 14 of the receiving unit 10. The closing unit 35 is formed from a base plate 36 and two closure plugs 37 and 38, projecting from the latter in the axial direction toward the receiving unit 10, whose outer diameters each correspond to that of the respective outlet opening 11 or 13.

Between the base plate 36 and the discharge duct 33 is arranged a mixing chamber 39 basically in the shape of a truncated cone, into which axial channels 71 and 72 of the closure plugs 37 and 38, emerge. The axial channels are each in the form of blind holes and are joined to a transverse channel 73 and 74 of the respective closure plug 37 and 38.

Furthermore, the dispensing unit 30 contains a cross member 75, from which positioning arms 76 and 77 project in the direction of the chambers 12, 14 of the dispensing unit 10, being set off from each other by 180 degrees relative to the axis of the discharge duct 33. The positioning arms 76 and 77 have at their free ends a cross piece or projection 78 and 79, projecting radially inward, and interacting with two locking lugs 81 and 82 or 83 and 84 arranged at the circumference of the neck region 15 of the receiving unit 10.

At the end faces near the receiving unit, the positioning arms 76, 77 have a pin or cam shaped projection 85 and 86, whose function shall be described further below.

Furthermore, a striplike shoulder 87 is formed on the circumference of the cylindrical segment 34 of the dispensing unit 30, extending in the axial direction, and engaging in a corresponding groove 88 on the inner circumferential surface of the neck region 15 for a twist-proof securing of the dispensing unit 30 in the neck region 15.

The locking lugs 81 to 84, which serve as a stop to protect the dispensing unit 30 against unintentional separation from the receiving unit 10, are each provided with a bevel on their side away from the chambers 12, 14 of the receiving unit 10, so that the respective cross piece 78 or 79 of the spring-elastic positioning arm 76 or 77 can be moved across the respective locking lug 81, 82, 83 or 84 without major resistance.

For the axial positioning of the dispensing unit 30, the positioning ring 40 is used, as shown in particular by FIGS. 11 and 12. This is mounted on the front plate 18 of the receiving unit 10 so that the marginal regions of the front plate 18 engage with an annular groove 41 of a base plate 42 of the positioning ring 40. On the base plate 42 of the positioning ring 40 there are arranged two ramps 43 and 44, displaced by 180 degrees from each other relative to the axis of the neck region 15, each of them being adjoined by a shoulder 45 and 46. The ramps 43 and 44 are fashioned as a wall and provided with a basically arc-shaped horizontal projection.

Furthermore, a groovelike recess 47 and 48 adjoins at least the lowered end regions of the ramps 43 and 44, away from the shoulders 45 and 46. This has the configuration of an arc and extends along the respective ramp 43 and 44.

The positioning ring 40 interacts with the positioning arms 76 and 77 of the dispensing unit 30 and thus defines the axial positioning of the dispensing unit 30.

When the dispensing unit is inserted into the neck region 15 of the receiving unit 10, the closure plugs 37 and 38 enter the respective outlet openings 11 and 13 of the chambers 12 and 14. The closure plugs 37 and 38 are dimensioned such in relation to the outlet openings 11 and 13 that the closure plugs 37 and 38 in a first entry position, constituting a closed position, close the outlet openings 11 and 13 fluid-tight by their free end segments. The transverse channels 73 and 74 are situated at the side of the front plate 18 away from the chambers 12 and 14. The end segment of the plug 38 entering the outlet opening 13 has a much larger cross section than the end segment of the closure plug 37 entering into the outlet opening 11. The positioning ring 40 is situated in a first position of turn, so that the free end faces of the positioning arms 76 and 77 lie against the shoulders 45 and 46 and thus a further shifting of the dispensing unit 30 toward the chambers 12, 14 is prevented. This position is shown in FIG. 1. When the dispensing unit 30 is inserted into the neck region 15, the cross pieces 78 and 79 move across the locking lugs 81 and 83, under elastic spreading apart or tilting of the positioning arms 76 and 77, so that they are locked between the locking lugs 81 and 83 on the one hand, now acting as a stop or securement, and the shoulders 45 and 46 on the other hand, likewise acting as a stop. At the side, the locking lugs 81 and 83 are then guided by a guideway 91 and 92 of boundary wall segments of the positioning arms 76 and 77.

In the first position of turn of the positioning ring 40, corresponding to a closed condition of the dispensing unit 30, the cross bars 78 and 79 of the positioning arms 76 and 77 thus interact with the locking lugs 81 and 83, whereby the dispensing unit is joined to the receiving unit 10 in captive manner.

At the same time, in this blocked condition a further movement of the dispensing unit 30 toward the receiving unit 10 is limited in that the end faces of the positioning arms 76, 77 knock against the shoulders 45 and 46. A given spacing will exist between the base plate 36 and the front plate 18, and the closure plugs 37, 38 have entered far enough into the outlet openings 11 and 13 that the plugs close the outlet openings fluid-tight.

In the closed position of the closure plugs 37 and 38, the chambers 12 and 14 can be filled with substances from their open back ends. After filling with the substances, the chambers 12 and 14 are closed from behind with the plungers 21 and 23 of the plunger unit 20. This closure position due to the closure plugs 37, 38 and the plungers 21, 23 is shown in FIG. 1. The substances filled into the chambers 12 and 14 are not depicted.

Now, if the multichamber dispensing device 100 is to be moved into the activation condition as shown in FIG. 2, the positioning ring 40, one will turn the positioning ring 40 into a second position of turn in which the positioning arms 76 and 77 each lie above a recessed region 47 and 48 of the base plate 42 of the positioning ring 40. In this position of turn of the positioning ring 40, an axial pressure is then exerted on the dispensing unit 30, until the positioning arms 76 and 77 strike the base plate 42 by their free end faces and the projections 85 and 86 of the positioning arms 76 and 77 engage with the recesses 47 and 48 on the base plate 42 of the positioning ring 40. In this way, a second entry position is produced for the closure plugs 37 and 38, in which the transverse channels 73 and 74 are arranged inside the chambers 12 and 14 and a fluid connection is produced by the transverse channels 73 and 74 and the axial channels 71 and 72 between the chambers 12 and 14 and the mixing chamber 39 or the discharge duct 33 of the dispensing unit 30. The inner cross section of the longitudinal channel 72 is much larger than that of the longitudinal channel 71. The same holds for the transverse channel 74 in relation to the transverse channel 73.

When the dispensing unit 30 is moved into the activation condition, the cross pieces 78 and 79 of the positioning arms 76 and 77 move across the locking lugs 82 and 84, so that the latter form a stopping point, securing the dispensing unit 30 in the activated condition.

In the activated condition of the two-chamber ampoule 100, shown in FIG. 2, by exerting pressure on the push plate 26 of the plunger unit 20, the substances contained in the chambers 12 and 14 can be forced through the transverse and axial channels 71 to 74 of the closing unit 35 of the dispensing unit 30 into the mixing chamber 39 and the discharge duct 33 and be delivered through the tip of the tubular segment 32 of the dispensing unit 30. For better mixing of the substances, a static mixer is provided in the discharge duct, not being shown in detail here.

Now, if the positioning ring 40 is turned further in relation to the representation in FIG. 11, the end faces of the positioning arms 76 and 77 slide on the ramps 43 and 44, so that the dispensing unit 30 undergoes an axial displacement in the direction away from the chambers 12 and 14. The projections 85 and 86 will lie against the circumferential surfaces of the ramps 43 and 44, so that the positioning arms 76 and 77 are tilted or spread apart in the direction away from the axis of the neck region 15. In this way, the cross pieces 78 and 79 can move across the locking projections 81, 82, 83 and 84. Thus, the dispensing unit 30 can be released and removed from the receiving unit 10. The region of the ramp 43 or 44 adjoining the shoulder 45 or 46 defines the third position of turn of the positioning ring 40, constituting a replacement position. The spreading apart of the positioning arms 76 and 77 in this position of turn of the positioning ring 40 is especially evident from FIG. 3.

The two-chamber ampoule 100 depicted is intended for use on multiple occasions. Therefore, only a fraction of the substances is expended from the chambers 12 and 14 during an application. After the application is over, the positioning ring 40 is turned to the third position of turn, representing the replacement position. In the third position of turn, the dispensing unit 30 can be taken out from the neck region 15. Now, a now dispensing unit 30 can be mounted on the receiving unit 10, after further turning of the positioning ring 40 to the first position of turn.

The replacement of the dispensing unit 30 can be done many times, until the chambers 12 and 14 are totally emptied.

The FIGS. 13 to 17 show a dispensing unit 30', as well as a closing unit 35' configured as a multiple-plug closure, of a second embodiment of a multichamber dispensing device, which otherwise corresponds to that in FIGS. 1 to 12.

The dispensing unit 30' has a cylindrical rear adapter segment 31. The cylindrical adapter segment 31 has such an outer diameter that it can be inserted from above into the open front end of a neck region 15 of a receiving unit, configured in accordance with FIGS. 4 to 6, and be moved therein fluid-tight. At a distance from the rear end, a circumferential wall 131 is formed on the inner surface of the cylindrical adapter segment 31, slanting inwardly and toward the front. The circumferential wall 131 bounds a mixing space 39 of truncated conical shape, open toward the rear. The narrower front end of the circumferential wall 131 passes into a tubular body, extending beyond the front end of the adapter segment 31 and representing a tubular segment 32 of the dispensing unit 30'. A discharge duct 33 extends in the longitudinal direction 30 inside the front tubular segment 32. The rear end of the discharge duct 36 and the front end of the mixing space 39 merge into each other.

On the front end of the cylindrical adapter segment 31 is formed a cross member 75, projecting radially outward. On the bottom side of the cross member 75 are formed locking or positioning arms 76 and 77, projecting to the rear at a distance from the outer circumference of the cylindrical adapter segment 31.

As is especially evident from FIG. 15 to 17, the multiple-plug closure 35' has two plugs 37 and 38, which are formed on the bottom side of a common platelike body 146. The platelike body 146 consists of a base plate 164, bordering the plugs 37 and 38, a middle plate 162 formed on the top side of the base plate, and a top plate 160 formed on the top side of the middle plate, constituting the front end of the multiple-plug closure 35'.

From the upper side of the top plate 160, two longitudinal channels 71 and 72 extend downward as far as the plugs 37 and 38. The longitudinal channel 71 emerges into a transverse channel 73 passing through the plug 37 in the transverse direction. The longitudinal channel 72 emerges into a transverse channel 74 passing through the plug 38 in the transverse direction. The transverse channels 73 and 74 are made at a predetermined distance from the lower ends of the plugs 37 and 38.

The top plate 160 has a circular circumferential wall with a diameter which is larger than that of the middle plate 162. In order to produce a rotary connection between the dispensing unit 30' and the multiple-plug closure 35', the top plate 160 can be snapped into an annular support groove 150 from the rear end of the dispensing unit 30', which is formed below the circumferential wall 131 on the inner surface of the cylindrical adapter segment 31 of the dispensing unit 30'. The groove 150 and the top plate 160 are matched up to each other in their dimensions so that the top plate 160 is supported in the groove 150 and can rotate. Removal of the top plate 160 from the groove 150 is prevented by an annular shoulder 152, which is fashioned at the rear end of the inner surface of the adapter segment 31. In order for the top plate 160 to snap more easily into the groove 150 during assembly, the radially inward pointing surface of the shoulder 152 is beveled in the manner shown. A lengthwise shifting of the top plate 160 upward or forward is prevented by a shoulder 154, which is fashioned on the bottom side of the circumferential wall 131.

On the upper side of the top plate 160, a cross rib 163 is formed, which interacts with two diametrically opposite recesses 153 in the shoulder 154 so that the multiple-plug closure 35' supported in the dispensing unit 30' and able to rotate can be locked in a given angle or turn position and released.

The dispensing unit 30' and the multiple-plug closure 35' are thus configured so that these two parts form a single structural unit 30', 35'.

When inserting the structural unit made up of dispensing unit 30' and multiple-plug closure 35' from the front or from above into the neck region 15 of the container 10, the plugs 37 and 38 enter into the outlet openings 11 and 13 of the chambers 12 and 14. The plugs 37 and 38 are dimensioned such in relation to the outlet openings 11 and 13 that they close the outlet openings 11 and 13 fluid-tight by their rear end segments when the plugs are in a first entry position. The transverse channels 73 and 74 will be situated above the front plate 18. The rear segment of the plug 38, inserted into the outlet opening 13, has a much larger cross section than the rear segment of the plug 38 inserted into the outlet opening 11.

In a second entry position of the plugs 37 and 38, when they are moved further downward or backward, the transverse channels 73 and 74 are located below the front plate 18, so that a fluid connection exists between the interior of the chambers 12 and 14 and the mixing space 39 or the discharge duct 32 of the dispensing unit 30' thanks to the transverse channels 73 and 74, as well as the longitudinal channels 71 and 72. The inner cross section of the longitudinal channel 72 is much larger than that of the longitudinal channel 71. The same holds for the transverse channel 74 as compared to the transverse channel 73.

The base plate 164 has a circumferential wall for better guiding of the multiple-plug closure 35' in the neck region 15, being adapted to the inner circumferential wall of the neck region 15 at least by partial areas of the circumference. In one such partial area of the circumferential wall of the base plate 164, a radially projecting shoulder 161 is formed. The shoulder 161 interacts with a longitudinal groove fashioned in the inner surface of the neck region 15 when initially inserting the multiple-plug closure 35' into the neck region 15 that the multiple-plug closure 35' can only be inserted into the neck region 15 in a given angle or turning position, in which the plugs 37 and 38 are aligned with the outlet openings 11 and 13 of the chambers 12 and 14.

Otherwise, the construction and mode of operation of the second embodiment correspond to the construction and mode of operation of the embodiment per FIGS. 1 to 12, i.e., a positioning ring is again provided, which defines the axial positioning of the structural unit made up of dispensing unit 30' and multiple-plug closure 35'.

The invention claimed is:

1. Multichamber dispensing device for dispensing of a mixture consisting of several substances, comprising:

a receiving unit with several chambers which are aligned parallel to each other and each of which is provided with a first end for inserting a plunger as well as a second end encompassing an outlet opening, and with a neck region that is located downstream from the outlet opening of the chambers; and a dispensing unit that is provided with a discharge duct and an adapter section for establishing a fluid-tight connection to the neck region of the receiving unit;

a positioning ring for axially positioning the dispensing unit and including at least one ramp, said positioning ring being rotatably mounted on the receiving unit and embracing the receiving unit; and at least one positioning arm extending from said dispensing unit and engaging said positioning ring, wherein upon rotation of said positioning ring, said at least one ramp engages said at least one positioning arm to axially move said dispensing unit.

2. Multichamber dispensing device per claim 1, in which the positioning ring has at least one position of turn constituting a position of rest, in which a flow of substance between the chambers and the discharge duct of the dispensing unit is blocked by means of the dispensing unit, and a second position of turn constituting a dispensing position, in which the substances can be delivered from the chambers into the discharge duct and be applied through the latter.

3. Multichamber dispensing device per claim 2, in which the positioning ring engages with a locking device in the position of rest and the dispensing position.

4. Multichamber dispensing device per claim 1, in which the positioning ring is mounted on a front plate extending transversely to the longitudinal axis of the chambers, being formed in the region of the second end of the chambers of the receiving unit.

5. Multichamber dispensing device per claim 1, in which the end region of the ramp away from the chambers defines a third position of turning of the positioning ring, in which the dispensing unit can be removed from the neck region of the receiving unit.

6. Multichamber dispensing device per claim 1, in which the dispensing unit is ejected from the neck region of the receiving unit by means of the ramp, by turning the positioning ring.

7. Multichamber dispensing device per claim 1, in which the ramp extends across an angle region of between around 90 and 160 degrees.

8. Multichamber dispensing device per claim 1, in which the positioning ring has an annular groove, in which the outer marginal region of the front plate engages.

9. Multichamber dispensing device per claim 1, in which the dispensing unit is mounted in the neck region unable to rotate.

10. Multichamber dispensing device per claim 9, in which the neck region has an elliptical cross section.

11. Multichamber dispensing device per claim 9, in which a turn preventer for the dispensing unit is arranged in the neck region.

12. Multichamber dispensing device per claim 1, in which the dispensing unit contains a cross member, from which the positioning arm stands off in the direction of the chambers of the receiving unit.

13. Multichamber dispensing device per claim 1, in which the positioning arm is elastically pretensioned in the direction of the axis of the neck region.

14. Multichamber dispensing device per claim 1, in which the positioning arm lies against a shoulder of the positioning ring in the first position of turn of the positioning ring.

15. Multichamber dispensing device per claim 1, in which the ramp interacts with the positioning arm such that the positioning arm tilts and releases the dispensing unit when the positioning ring is turned in the direction away from the axis of the neck region.

16. Multichamber dispensing device per claim 1, in which at least one locking means for the positioning arm is arranged on the outer wall of the neck region, preferably interacting with a cross piece of the positioning arm.

17. Multichamber dispensing device per claim 16, in which the locking means secures the dispensing unit in the position of rest and/or in the dispensing position of the positioning ring.

18. Multichamber dispensing device per claim 16, in which the locking means has a bevel on the side away from the chambers of the receiving unit.

19. Multichamber dispensing device per claim 1, in which the dispensing unit is provided with a closing unit for the outlet openings of the chambers of the receiving unit.

20. Multichamber dispensing device per claim 19, in which the closing unit contains a closure plug coordinated with the respective outlet opening for each chamber of the receiving unit.

21. Multichamber dispensing device per claim 20, in which the closure plugs free up in the dispensing position a flow of substance to a mixing chamber, which is arranged in the dispensing unit upstream from the discharge duct.

22. Multichamber dispensing device per claim 21, in which the closure plugs are each provided with a transverse channel, which is connected to a blind axial channel that leads to the mixing chamber.

23. Multichamber dispensing device per claim 19, in which the closing unit has a platelike body, which is rotatably supported at the side of the dispensing unit facing the receiving unit.

24. Multichamber dispensing device per claim 23, in which locking means are fashioned on the dispensing unit and the platelike body of the closing unit, which cooperate in such a way that the dispensing unit and the closing unit can lock together in a given position of angular turning.

25. Multichamber dispensing device per claim 24, in which a shoulder projecting in the transverse direction is formed on the platelike body of the closing unit, which interacts with a longitudinal groove fashioned inside the neck region so that the closing unit can only be inserted into the neck region in one given position of angular turning, in which the closure plugs of the closing unit are each aligned with respective outlet openings of the chambers.

* * * * *